US007726059B2

(12) United States Patent
Pikielny

(10) Patent No.: US 7,726,059 B2
(45) Date of Patent: Jun. 1, 2010

(54) LOCKABLE SAFETY FOR FIREARM

(76) Inventor: Dov Pikielny, 7 Dov Hoz St., Herzliya 46581 (IL)

( * ) Notice: Subject to any disclaimer, the term of this patent is extended or adjusted under 35 U.S.C. 154(b) by 120 days.

(21) Appl. No.: 11/683,055

(22) Filed: Mar. 7, 2007

(65) Prior Publication Data

US 2008/0216376 A1 Sep. 11, 2008

(51) Int. Cl.
*F41A 17/02* (2006.01)

(52) U.S. Cl. ..... 42/70.11; 42/70.05

(58) Field of Classification Search ..... 42/70.01, 42/70.04, 70.05, 70.06, 70.07, 70.08, 70.09, 42/70.11
See application file for complete search history.

(56) References Cited

U.S. PATENT DOCUMENTS 3,882,622 A * 5/1975 Perlotto ..... 42/70.11
4,414,769 A * 11/1983 Mueschke ..... 42/70.01
4,590,697 A * 5/1986 Ruger et al. ..... 42/70.08
4,934,086 A * 6/1990 Houde-Walter ..... 42/115
5,179,235 A * 1/1993 Toole ..... 42/115
5,212,327 A * 5/1993 Schuemann ..... 42/70.01
5,467,550 A * 11/1995 Mumbleau ..... 42/70.11
5,509,226 A * 4/1996 Houde-Walter ..... 42/117
5,704,153 A * 1/1998 Kaminski et al. ..... 42/70.11
5,867,930 A * 2/1999 Kaminski et al. ..... 42/70.11
5,896,691 A * 4/1999 Kaminski et al. ..... 42/70.11
5,903,994 A * 5/1999 Tange ..... 42/70.01
6,237,271 B1 * 5/2001 Kaminski ..... 42/70.06
6,260,298 B1 * 7/2001 Bubits ..... 42/70.08
6,347,538 B1 * 2/2002 Doiron ..... 70/58
6,363,647 B2 * 4/2002 Kaminski ..... 42/70.11
6,389,728 B1 * 5/2002 Lundy ..... 42/70.11
6,405,471 B1 * 6/2002 Mauch ..... 42/70.11
6,412,207 B1 * 7/2002 Crye et al. ..... 42/70.06
6,474,011 B1 11/2002 Sato
6,481,140 B1 * 11/2002 Marshall ..... 42/70.11
6,510,641 B1 * 1/2003 Viani ..... 42/70.08
6,629,379 B1 * 10/2003 Doiron ..... 42/70.11
6,691,445 B2 * 2/2004 Williams ..... 42/70.08
6,766,606 B2 * 7/2004 Fluhr et al. ..... 42/70.06
6,851,213 B1 * 2/2005 Doiron ..... 42/70.11
6,889,459 B1 * 5/2005 Salvitti ..... 42/70.08
7,234,261 B2 * 6/2007 McGarry ..... 42/70.05
7,243,453 B2 * 7/2007 McGarry ..... 42/70.08
7,337,574 B2 * 3/2008 Crandall et al. ..... 42/75.03
7,406,793 B2 * 8/2008 McClellan ..... 42/66
2001/0032405 A1 * 10/2001 Kaminski ..... 42/70.05
2001/0037596 A1 * 11/2001 salvitti ..... 42/70.08
2002/0020100 A1 * 2/2002 Roca et al. ..... 42/70.11
2002/0174585 A1 * 11/2002 Fluhr et al. ..... 42/70.01
2002/0194762 A1 * 12/2002 Cominolli ..... 42/70.06

(Continued)

FOREIGN PATENT DOCUMENTS

DE 10052466 4/2002

(Continued)

*Primary Examiner*—Benjamin P Lee
(74) *Attorney, Agent, or Firm*—Dekel Patent Ltd; David Klein

(57) ABSTRACT

A firearm including a safety that moves between a safe position that does not permit firing of the firearm and a fire position that permits firing of the firearm, and a lock that locks the safety in the closed position wherein the lock includes an ambidextrous locking mechanism actuable from both sides of the firearm.

9 Claims, 15 Drawing Sheets

U.S. PATENT DOCUMENTS

| | | | | |
|---|---|---|---|---|
| 2003/0089016 | A1* | 5/2003 | Hyytinen | 42/70.11 |
| 2003/0213159 | A1* | 11/2003 | Cutini et al. | 42/70.06 |
| 2005/0188582 | A1* | 9/2005 | Doiron et al. | 42/70.06 |
| 2005/0229461 | A1* | 10/2005 | McGarry | 42/70.08 |
| 2005/0229462 | A1* | 10/2005 | McGarry | 42/70.08 |
| 2008/0110075 | A1* | 5/2008 | Pikielny | 42/70.01 |

FOREIGN PATENT DOCUMENTS

| | | |
|---|---|---|
| EP | 1327848 | 7/2003 |
| EP | 1586848 | 10/2005 |

* cited by examiner

LOCKABLE SAFETY FOR FIREARM

FIELD OF THE INVENTION

The present invention relates generally to firearms, and particularly to a safety for a firearm (e.g., handgun, pistol, revolver, rifle, machine gun, etc.) that can be locked.

BACKGROUND OF THE INVENTION

It is well known in the art to provide firearms, such as handguns, with one or more safeties. Some safeties are opened to permit firing the firearm by following correct firing procedures. For example, a well known trigger safety includes a second type of trigger that is squeezed together with the firing trigger during normal, safe operation of the firearm. Likewise, a grip safety is opened when the firearm is properly gripped by the user. Such safeties will be referred to herein as passive safeties.

There are other safeties that must be opened by means of some action independent of the action of simply gripping the firearm, pulling the trigger and firing a projectile from the firearm. An example is a thumb-actuated safety, e.g., a knob or lever that must be moved by a thumb or other finger to permit firing the firearm. Such safeties will be referred to herein as active safeties.

Locks for locking weapons to prevent unauthorized use thereof are very well known in the art. For example, U.S. Pat. Nos. 6,647,655 and 6,889,459 to Salvitti, the disclosures of which are incorporated herein by reference, describe a firearm safety lock for the Model 1911 automatic pistol. The safety lock includes a means of arresting the operation of the main trigger or hammer spring in the pistol grip of the firearm to prevent movement of the hammer, thereby locking the gun in a safe condition. In one of the embodiments, the lock is operated by a keyed device or specialized tool. Such a device could be a simple miniature key lock mechanism, a combination lock integrated into the handle of the gun, or some other snap lock ratcheting mechanism, much like that used in a ball point pen, to withdraw and extend the ball point sequentially.

U.S. Pat. Nos. 6,269,576 and 6,691,445 to Williams describe a mechanism for disabling a firearm. The disablement mechanism includes a body positionable to block movement of the hammer spring assembly in order to prevent the hammer from being moved to its cocked position.

US Patent Application 20050229461 to McGarry, the disclosure of which is incorporated herein by reference, describes a pistol equipped with a lockable manual safety mechanism. The firing apparatus may include a trigger, a trigger bar, a sear, and a hammer that contacts a firing pin which may strike a chambered cartridge. The manual safety may be movable into and out of engagement with the firing apparatus. In one embodiment, the safety engages the sear to prevent the sear from moving and releasing the hammer while held in the cocked position by the sear. In one embodiment, the manual safety is a lever that is pivotally mounted to the frame of the pistol. The pistol may further include a locking member that engages the safety. The locking member may be movable from an unlocked position in which the manual safety is freely movable, to a locked position engaging the manual safety so that the safety cannot freely move and is locked into engagement with the sear while the hammer is held in the cocked position by the sear.

In one embodiment of US20050229461, the locking member may be a lock pin that may be rotatably carried by the pistol and is used the pistol user to lock the manual safety lever in the safe position. In one embodiment, the manual safety lever includes a locking concave surface that matches and meshes with a complimentary-shaped lever engaging surface of the safety lock pin. In one embodiment, the lock pin is key-operated.

SUMMARY OF THE INVENTION

The present invention seeks to provide a lockable safety for firearms, such as but not limited to, handguns, pistols, revolvers, rifles, machine guns and others, as is described more in detail hereinbelow. In contrast with the prior art, the locking mechanism of the lockable safety is ambidextrous, that is, is operable from both sides of the firearm for both right-handed and left-handed shooters.

The present invention seeks to provide a universal locking concept/mechanism, which under slight modifications can be universal to all models of guns/rifles/pistols/revolvers, having an external thumb safety or other active safety. The present invention is also applicable and may be universal for passive safeties, too, such as but not limited to, grip and trigger safeties.

One advantage of the present invention is the universality of the locking mechanism. The shooter does not have to search for the locking mechanism, since it can be in the same place for all firearms, for example, fashioned as a locking cylinder at or in the thumb safety.

Another advantage is that no matter whether the firearm is lying on the left or the right side, since the locking devise is ambidextrous, one side will always be exposed so that it is clear, even without touching but just by glancing, if the firearm is in a locked/safe mode or an unlocked mode.

There is provided in accordance with an embodiment of the present invention a firearm including a safety that moves between a safe position that does not permit firing of the firearm and a fire position that permits firing of the firearm, and a lock that locks the safety in the closed position wherein the lock includes an ambidextrous locking mechanism actuable from both sides of the firearm.

In one embodiment, the safety is pivoted about a pivot and the lock is positioned at the pivot, wherein when the lock is in a locked position, the lock has a portion that blocks movement of the safety about the pivot to the fire position.

In another embodiment, the safety is pivoted about a pivot and the lock is not positioned at the pivot, wherein when the lock is in a locked position, the lock has a portion that blocks movement of the safety about the pivot to the fire position. The portion of the lock that blocks movement of the safety about the pivot may include different elements. In one embodiment, the blocking portion is a lug that juts outwards from the firearm. In another embodiment, the blocking portion is a lever that pivots about an axis to abut against the safety and prevent movement of the safety.

The safety may be an active safety that must be moved to the fire position by an action independent of gripping the firearm, pulling a trigger and firing a projectile from the firearm. The safety could alternatively be a passive safety.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1A:
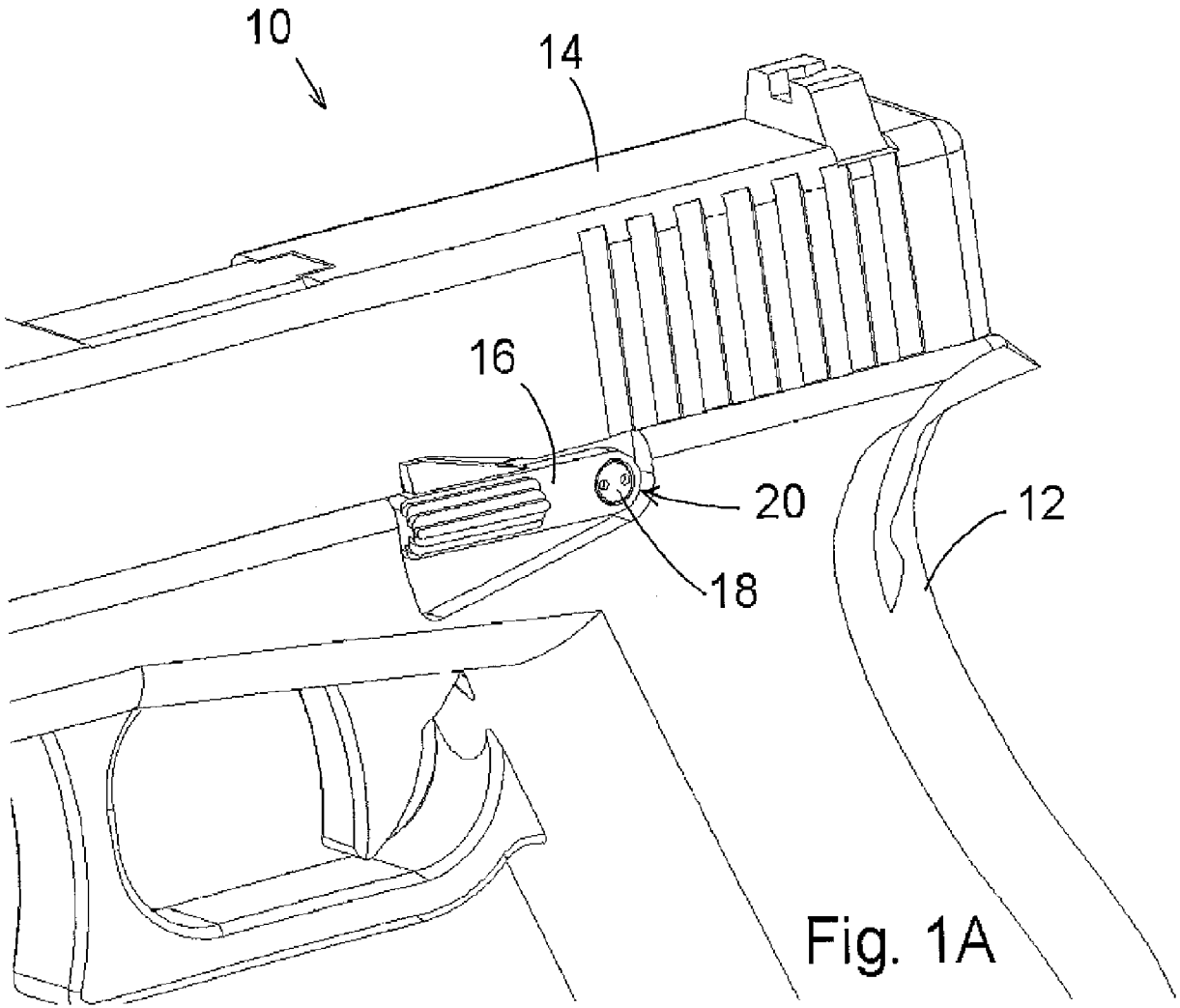
FIGS. 1A and 1B are simplified pictorial illustrations of a firearm, constructed and operative in accordance with an embodiment of the present invention, showing a safety in respective closed (not permitting firing of the firearm) and open (permitting firing of the firearm) positions (also referred to as safe and firing modes, respectively), and including a lock for locking the safety.
Figure 1B:
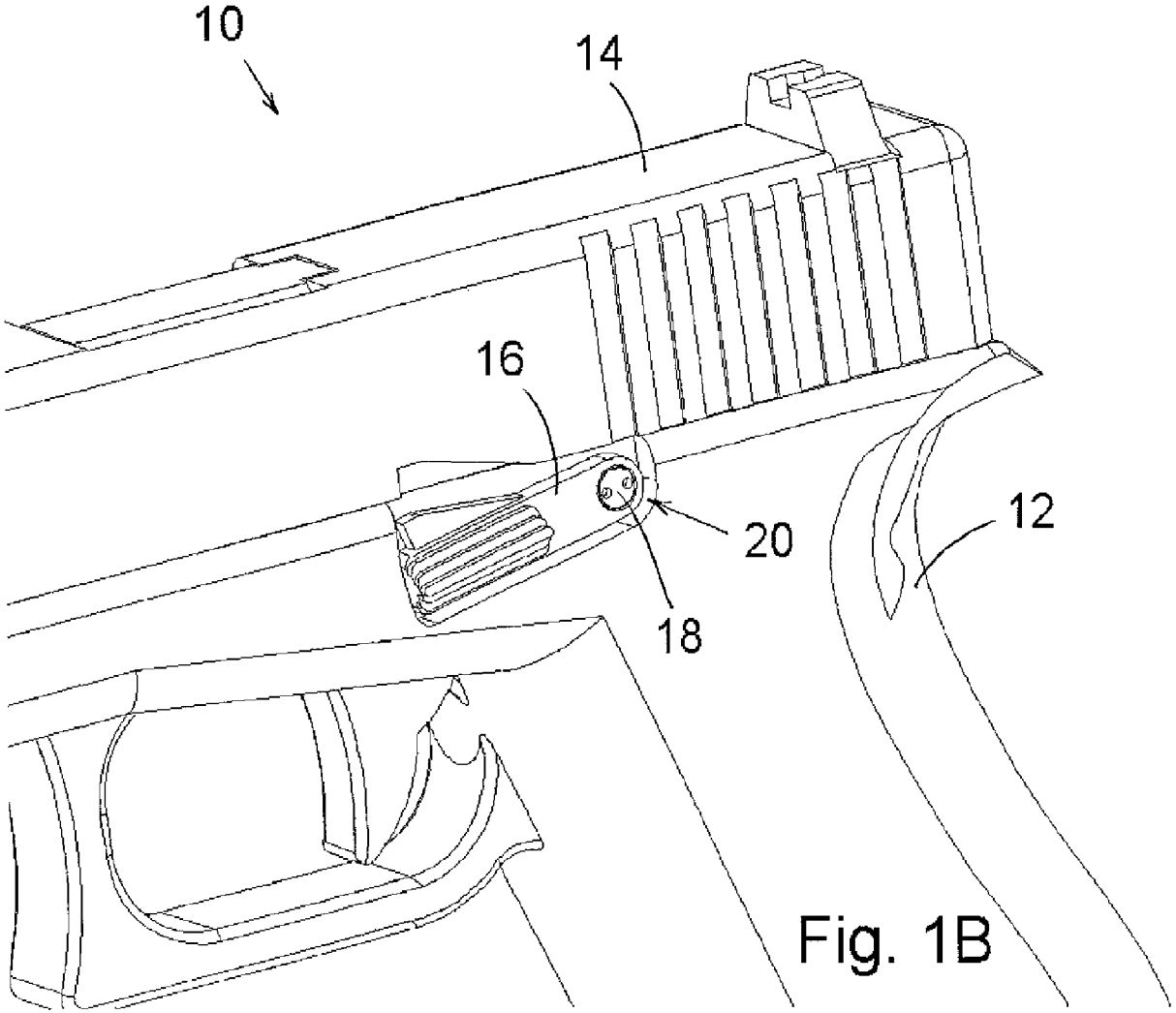

Reference is now made to FIGS. 1A-1B, which illustrates a firearm (e.g., handgun) 10, constructed and operative in accordance with an embodiment of the present invention. The illustrated firearm shown is a type of handgun, but this is merely for the sake of simplicity and clarity, and the present invention is in no way limited by this particular illustrated construction.

Firearm 10 may have a frame assembly 12 and a firing assembly that includes a slide 14. Those skilled in the art will readily appreciate that only those parts of firearm 10 that are needed to explain the present invention are shown, but the firing assembly of firearm 10 in actuality may include many other parts, such as but not limited to, a barrel, a breech block, a trigger, a trigger bar, a sear, a striker, and various springs that are well known in the art and are therefore do not require detailed description and are omitted in the drawing for the sake of simplicity.

Firearm 10 may include a safety 16 that moves between a safe position (FIG. 1A) that does not permit firing of the firearm and a fire position (FIG. 1B) that permits firing of the firearm. Safety 16 is a thumb safety, a type of active safety that must be moved to the fire position by an action independent of gripping the firearm, pulling a trigger and firing a projectile from the firearm. Safety 16 may pivot about a pivot 18.

Figure 1C:
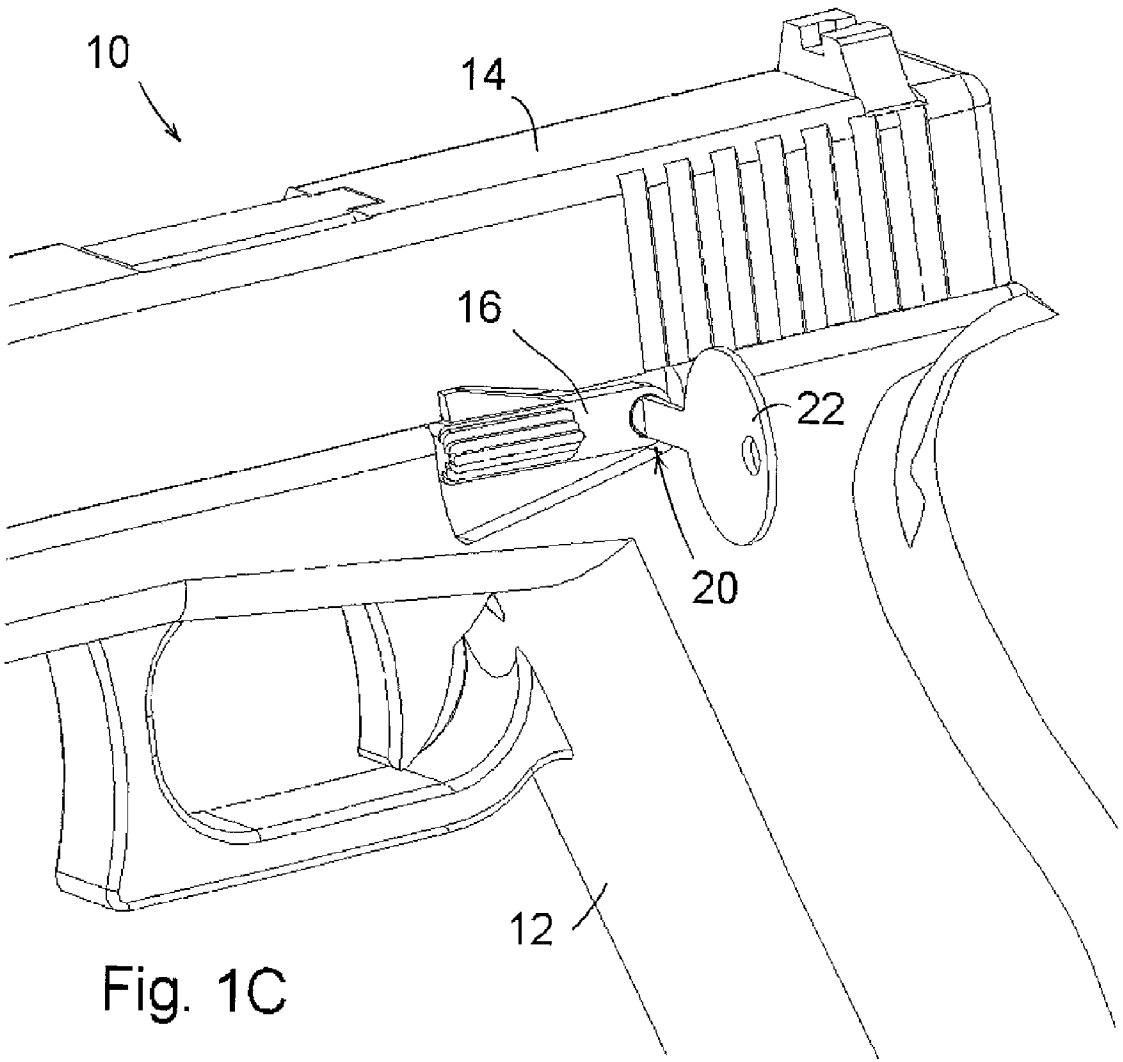
FIGS. 1C and 1D are simplified pictorial illustrations of a key inserted in the lock of the safety of FIGS. 1A and 1B, respectively before and after turning the key to lock the lock.
Figure 1D:
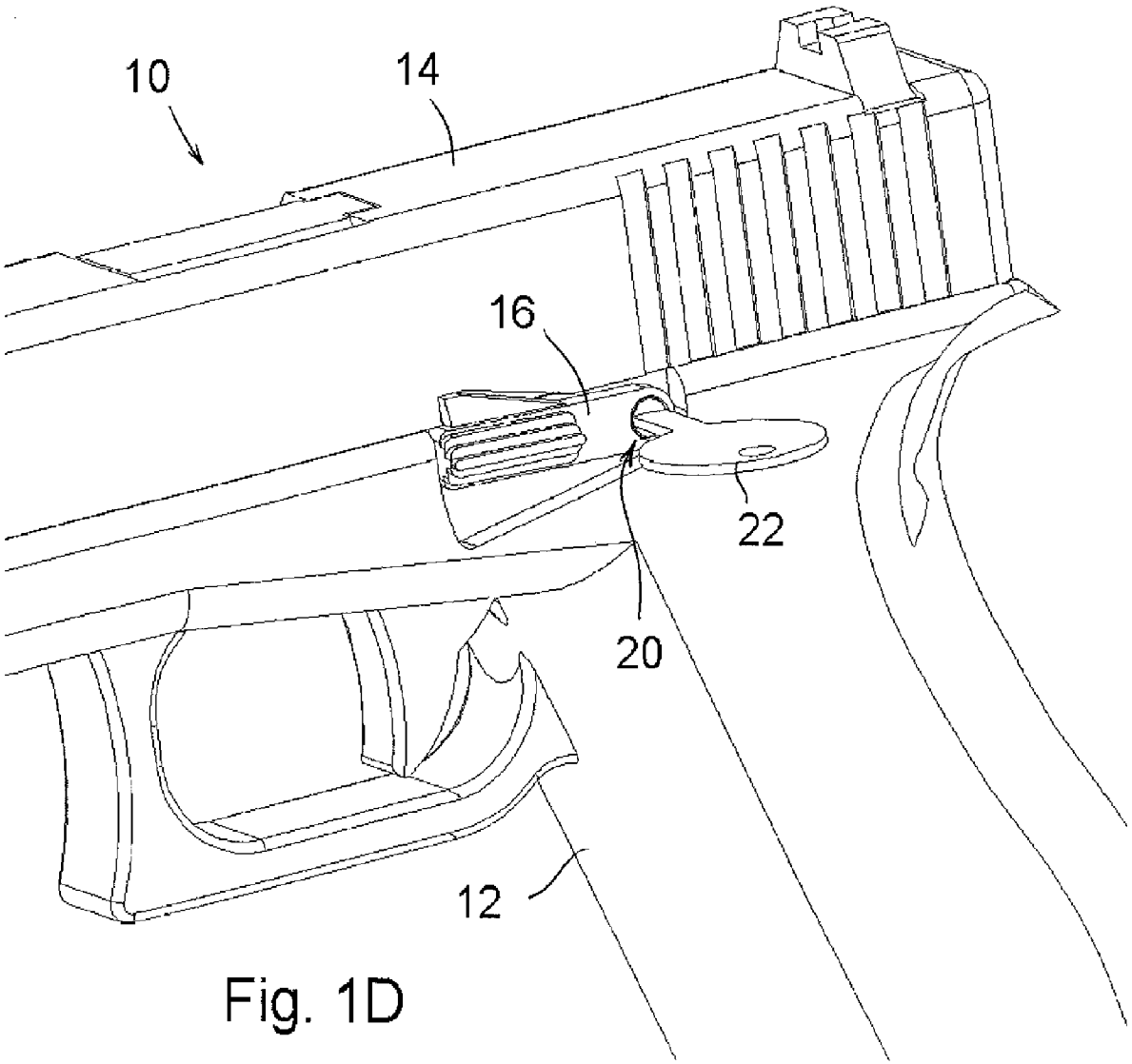
Figure 1E:
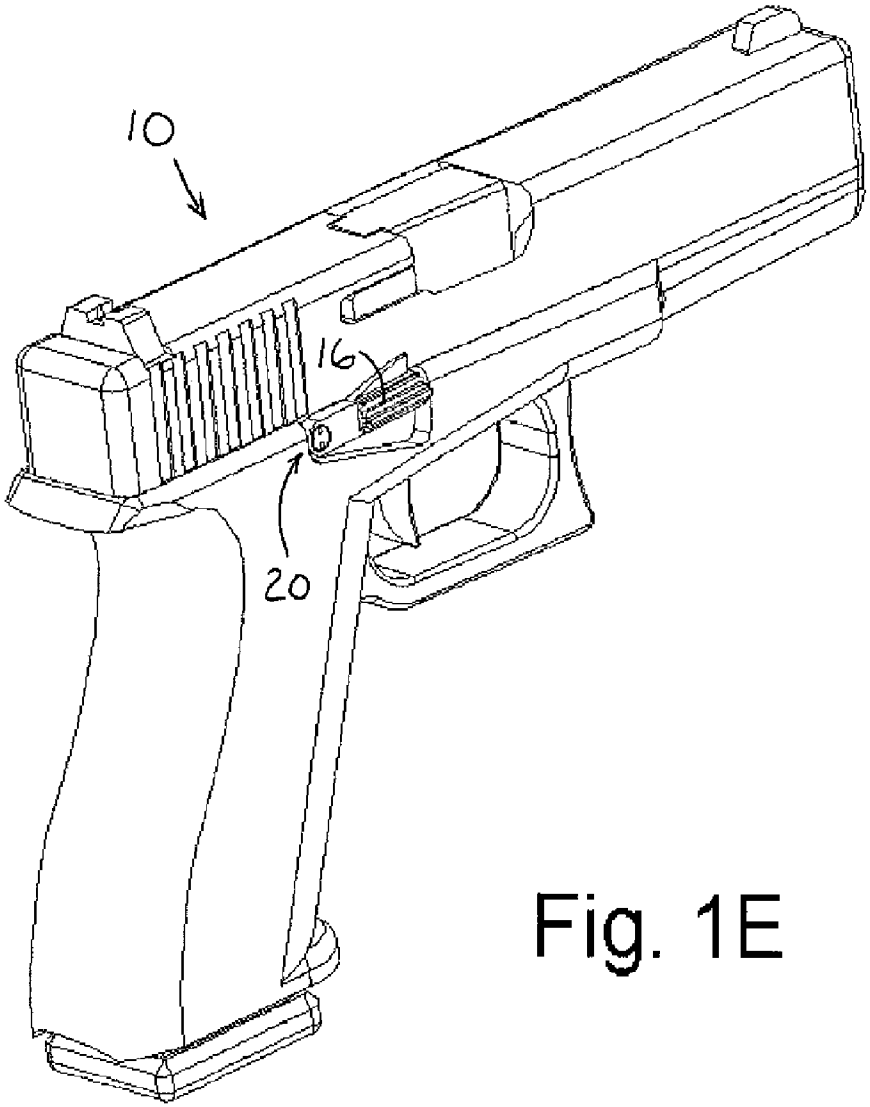
FIGS. 1E and 1F are simplified pictorial illustrations of the key inserted in the lock of the safety of FIGS. 1A and 1B on the other side of the firearm, respectively with and without a thumb safety on that other side of the firearm.
Figure 1F:
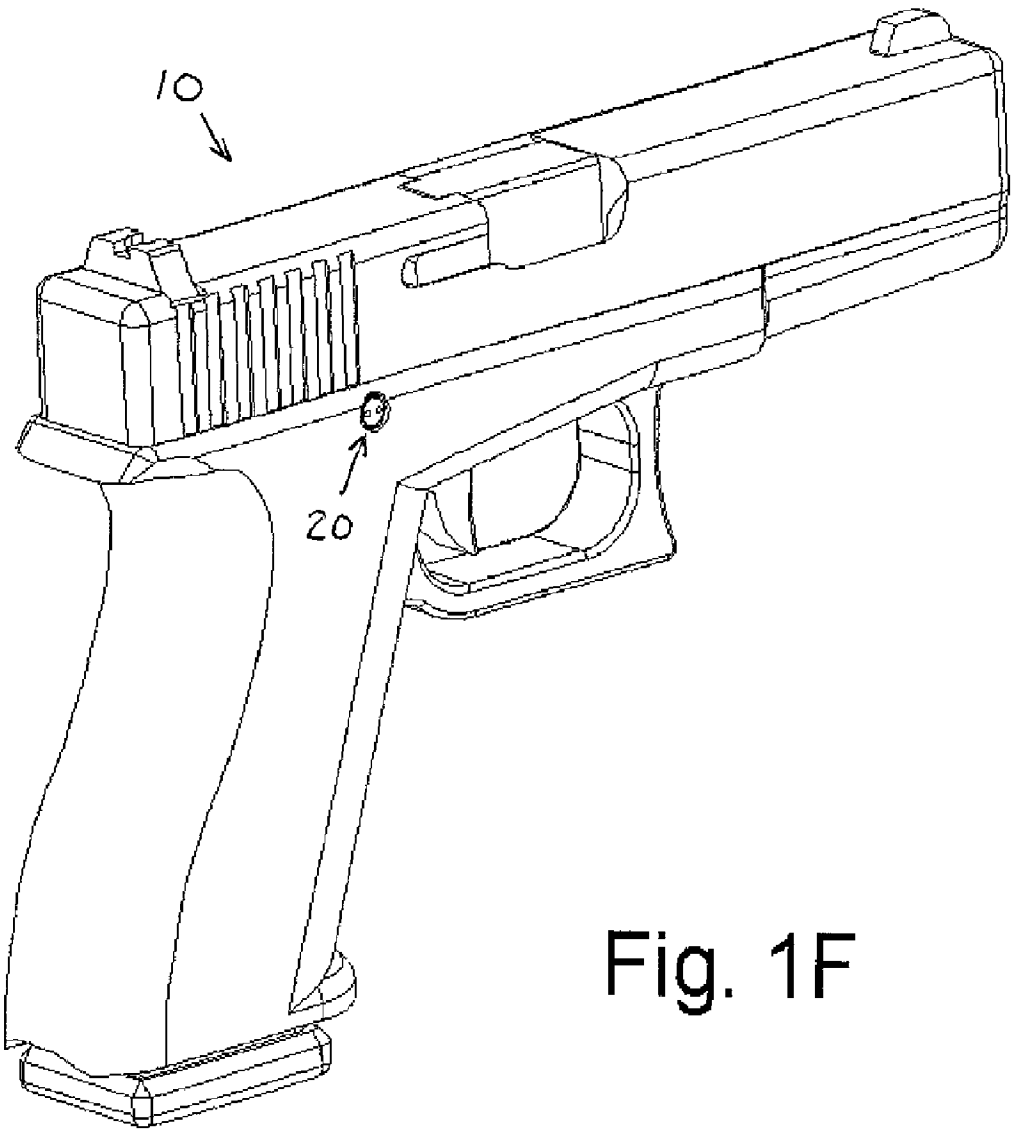

Firearm 10 may include a lock 20 that locks safety 16 in the safe position. Lock 20 may be a simple miniature key-operated lock mechanism, such as but not limited to, a ratchet mechanism. For example, lock 20 may be positioned at the pivot 18. Referring to FIGS. 1C and 1D, a key 22 may be inserted in lock 20. In FIG. 1C, lock 20 is in a non-ratchet or "free rotation" position that permits pivoting the lever of safety 16 about pivot 18. In FIG. 1D, lock 20 is in a ratchet or "non-rotation" position that does not permit pivoting the lever of safety 16 about pivot 18. Referring to FIGS. 1E and 1F, it is seen that lock 20 is an ambidextrous locking mechanism actuable from both sides of firearm 10. In FIG. 1E, the safety 16 is also ambidextrous and thus has a lever on both sides of the firearm. In FIG. 1F, the safety 16 is not ambidextrous and thus has a lever only on one side of the firearm.

Another example of a simple miniature key-operated lock mechanism that may be positioned at the pivot 18 is the same type of lock mechanism used to prevent rotation of a doorknob. In many conventional door lock systems, such as manufactured by Sargent or Corbin, the inner doorknob includes a centrally positioned button or knob thereon which can be selectively set in a position causing prevention of rotation of the outer knob and spindle. This same locking mechanism is another example of a mechanism that can be used in lock 20.

Figure 2A:
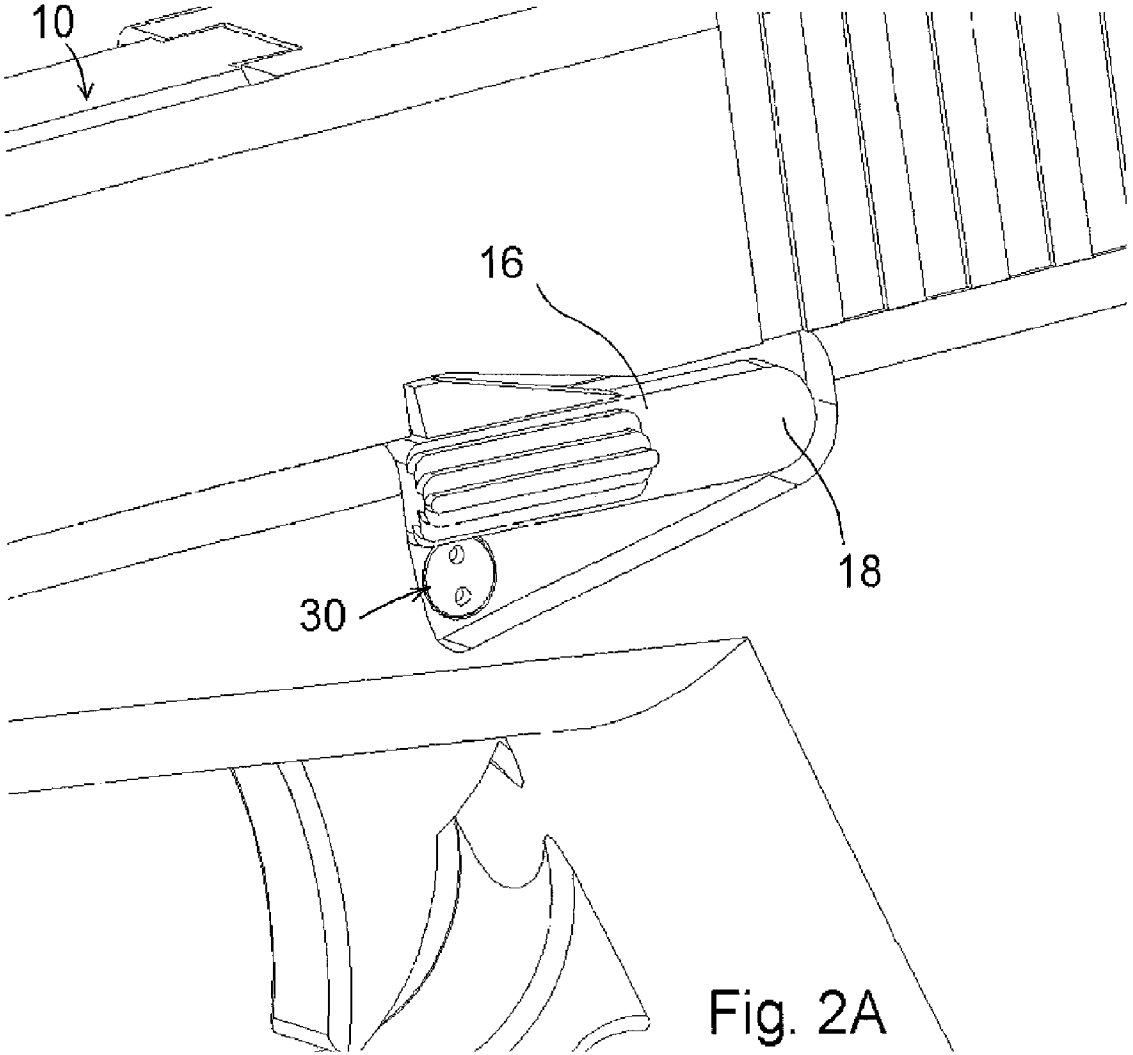
FIGS. 2A and 2B are simplified pictorial illustrations of a firearm, constructed and operative in accordance with another embodiment of the present invention, showing a safety in respective safe and firing positions, and including a lock for locking the safety.
Figure 2B:
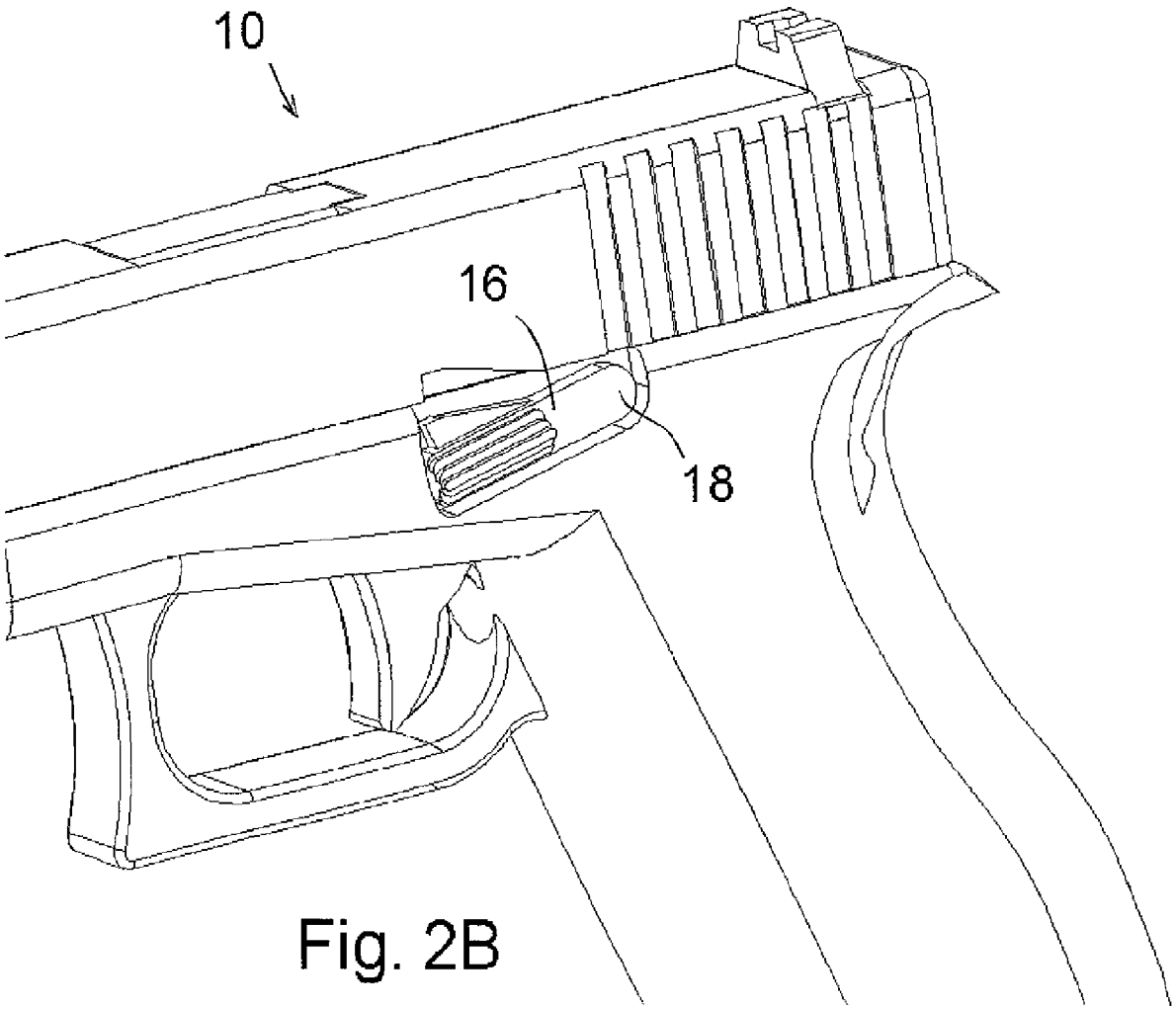
Figure 2C:
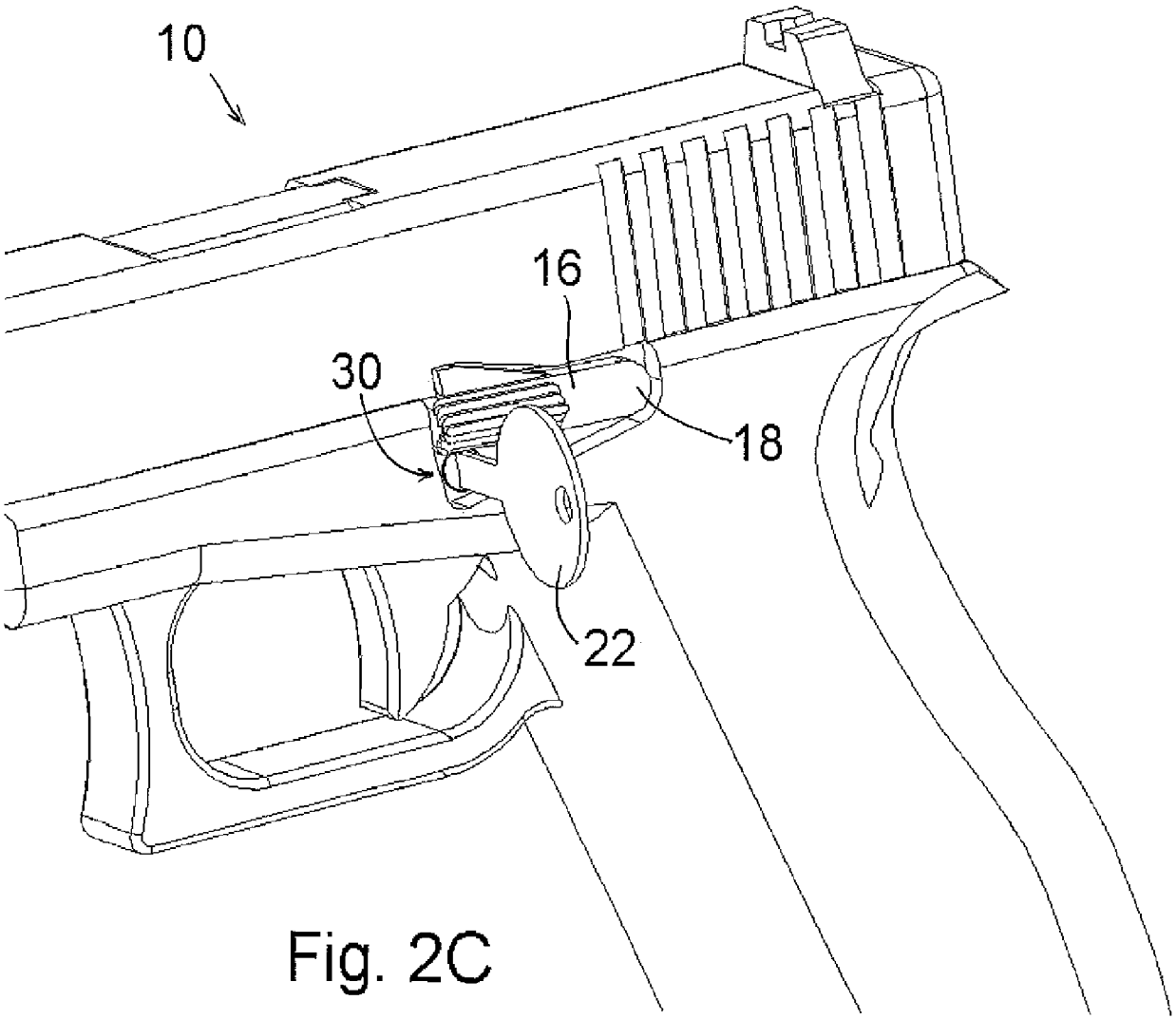
FIGS. 2C and 2D are simplified pictorial illustrations of a key inserted in the lock of the safety of FIGS. 2A and 2B, respectively before and after turning the key to lock the lock.

Reference is now made to FIGS. 2A and 2B, which illustrate firearm 10, constructed and operative in accordance with another embodiment of the present invention, showing safety 16 in respective safe and firing positions.

Figure 2D:
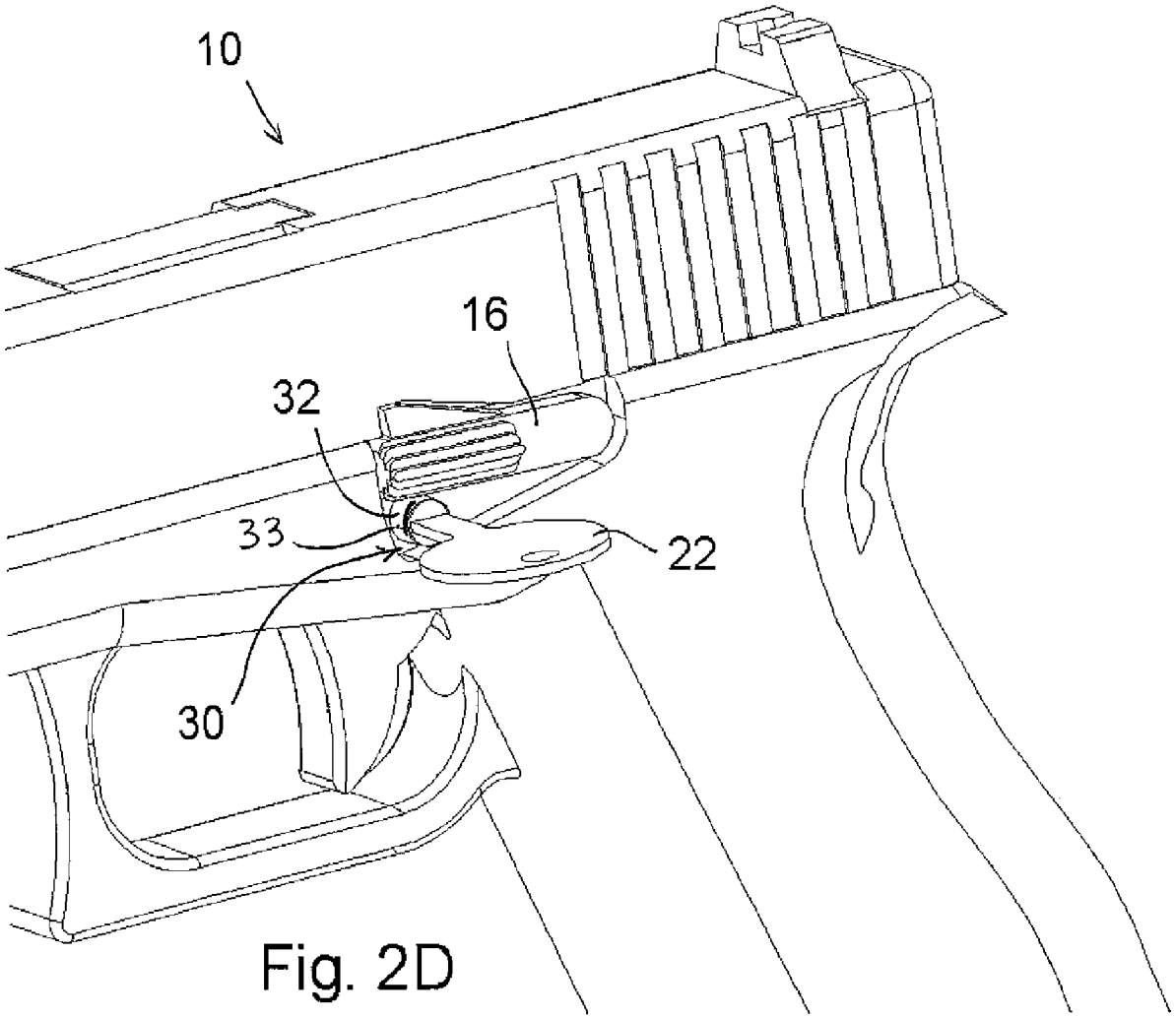

As before, safety 16 is pivoted about pivot 18. In the embodiment of FIGS. 2A and 2B, however, a lock 30 is provided which is not positioned at pivot 18. Lock 30 includes a portion 32 (seen best in FIG. 2D) that blocks movement of safety 16 about pivot 18 to the fire position. The blocking portion 32 may be a lug that juts outwards from the firearm, in which case lock 30 may be the type of lock used in filing cabinets, such locks being well known in the art.

Figure 3A:
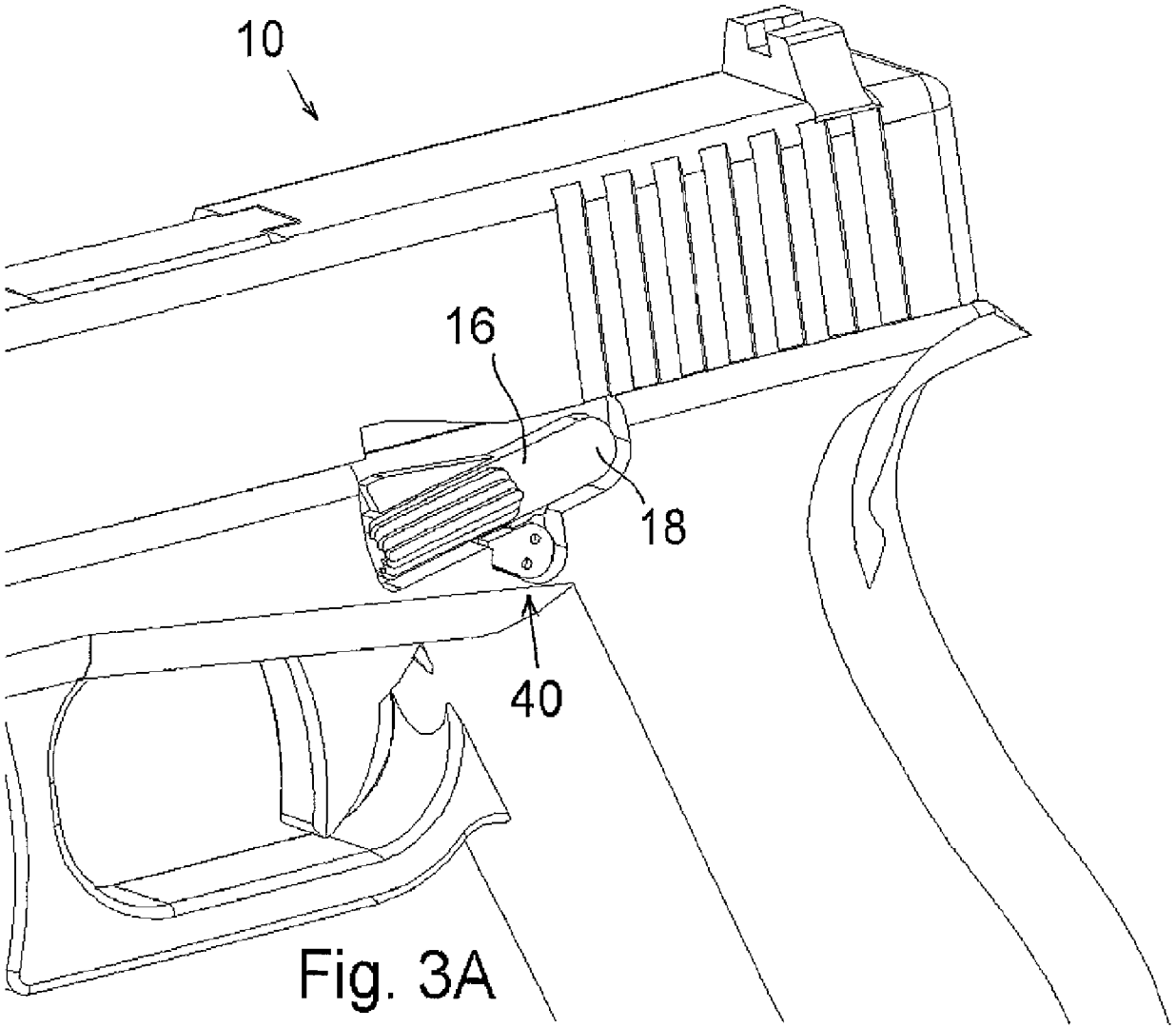
FIGS. 3A and 3B are simplified pictorial illustrations of a firearm, constructed and operative in accordance with yet another embodiment of the present invention, showing a safety in respective safe and firing positions, and including a lock for locking the safety.
Figure 3B:
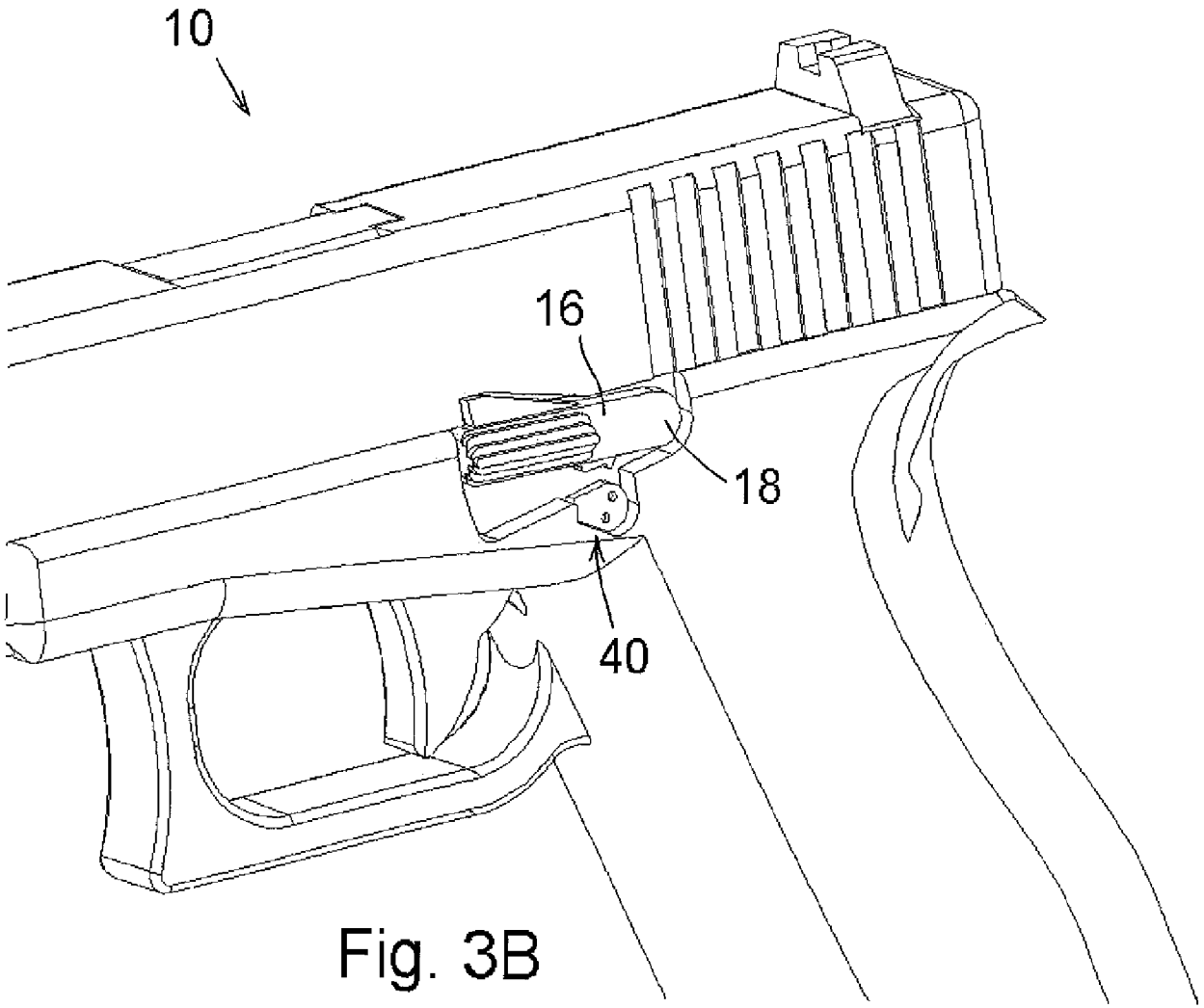
Figure 3C:
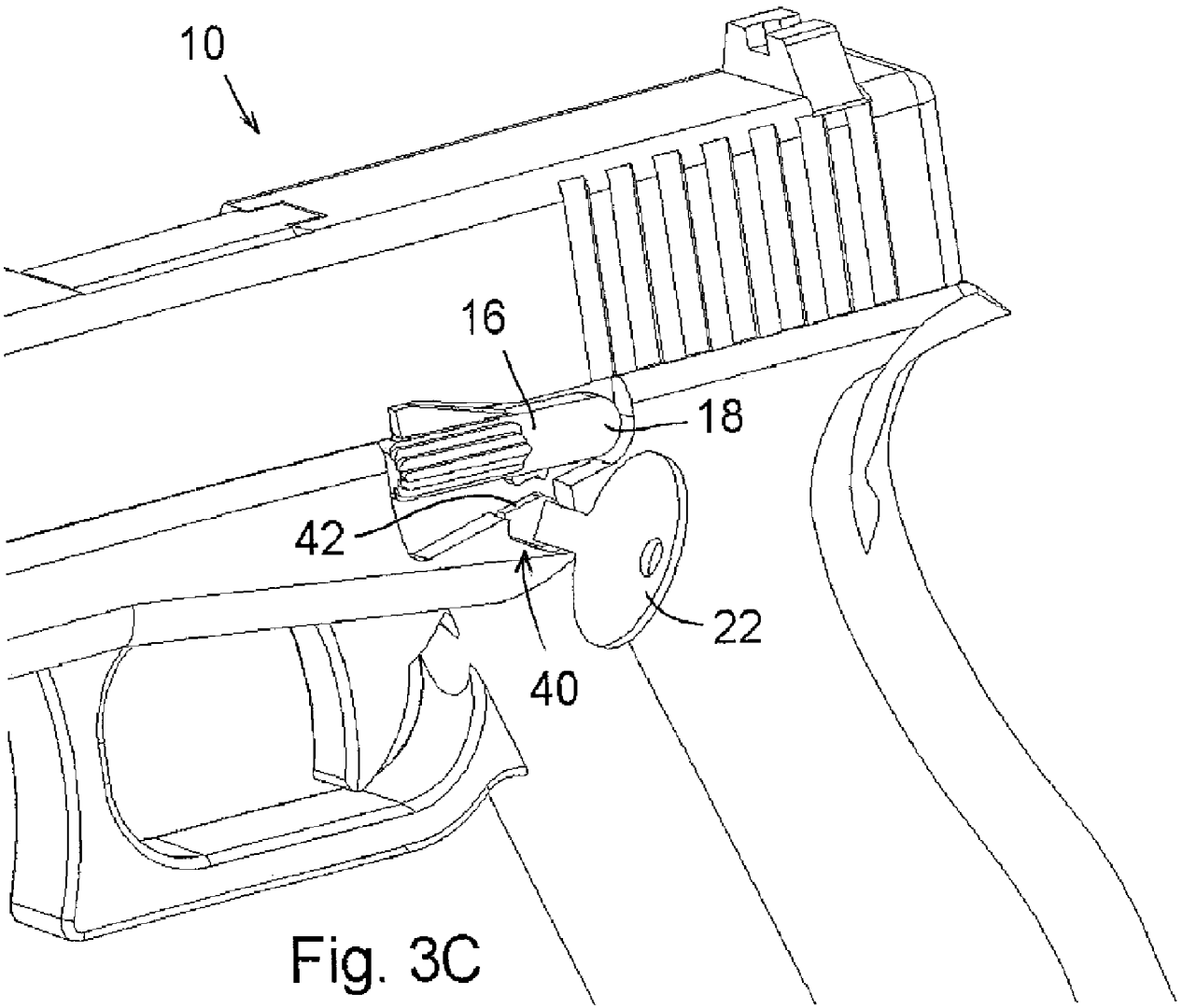
FIGS. 3C and 3D are simplified pictorial illustrations of a key inserted in the lock of the safety of FIGS. 3A and 3B, respectively before and after turning the key to lock the lock.
Figure 3D:
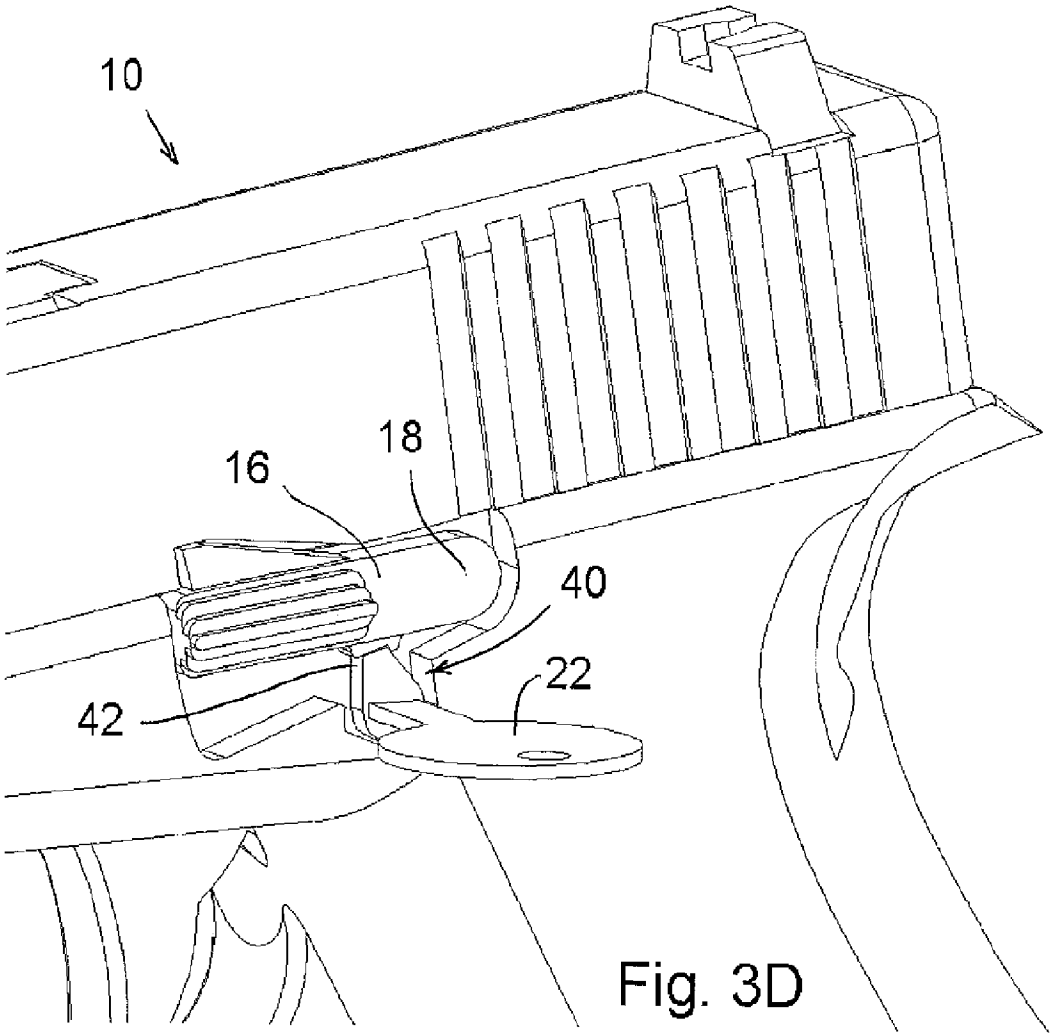
Figure 4:
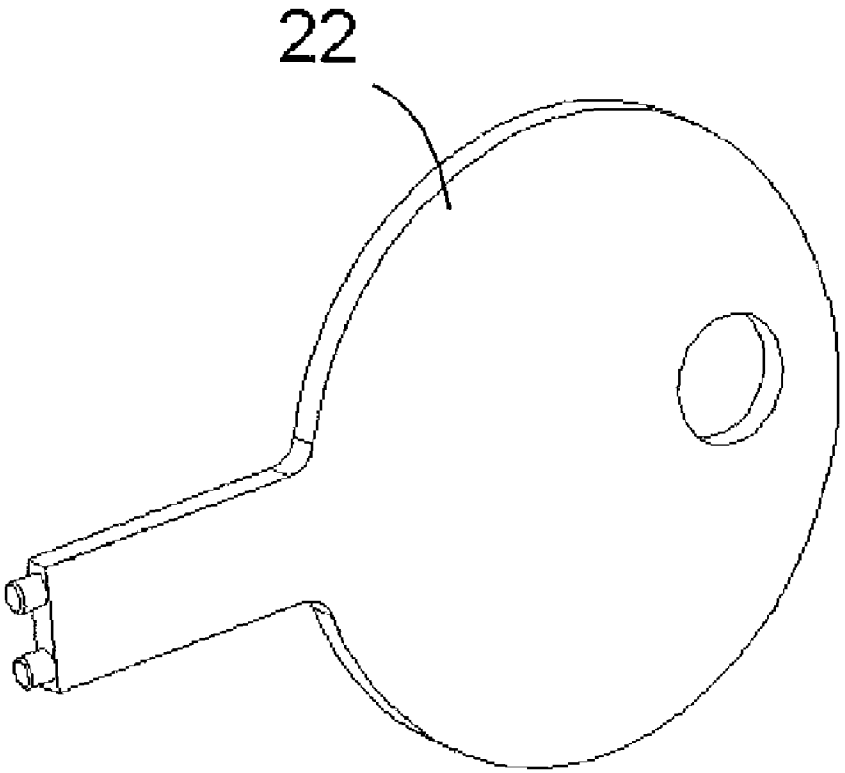
FIG. 4 is a simplified illustration of a key, constructed and operative in accordance with an embodiment of the present invention.

Reference is now made to FIGS. 3A and 3B, which illustrate firearm 10, constructed and operative in accordance with yet another embodiment of the present invention, showing safety 16 in respective safe and firing positions. In the embodiment of FIGS. 3A and 3B, a lock 40 is provided which is not positioned at pivot 18. Lock 40 includes a blocking portion 42 which is a lever that pivots about an axis to abut against safety 16 and prevent movement of safety 16.

In Applicant's co-pending U.S. patent application Ser. No. 11/672,073, entitled "Firearm With On-Off Safety Switch", the disclosure of which is incorporated herein by reference, there is described a safety that doubles as an on-off switch for electrical accessories. The safety, which may be a thumb safety for example, is in electrical communication with a power source and the switch serves as an electrical switch for switching power from the power source to an electrically activated component of the firearm, such as an internal laser device. In accordance with an embodiment of the present invention, safety 16 may thus doubles as an on-off switch for electrical accessories and the lock 20 or 30 or 40 may lock the switch in an off position.

In accordance with another embodiment of the present invention, when the safety 16 is locked in the safe position, a visual indication may be provided to indicate that the firearm 10 is in the safe mode. For example, in the embodiment of FIG. 2A, blocking portion 32 may be a lug that juts outwards from the firearm. In this case, the visual indication may be a red stripe 33 (seen in FIG. 2D) that juts out together with blocking portion 32. In the embodiment of FIGS. 1A and 1B, the visual indication may be a circular disc with a red sector. When the key is turned to lock the lock, the disc turns and the red sector becomes visible through a window. Other colors of course may be used and there may also be a visual indication for the fire mode (e.g., a green indicator).

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. An article comprising:

a first side;

a second side opposite said first side;

a firearm comprising a safety that moves between a safe position that does not permit firing of the firearm and a fire position that permits firing of the firearm;

a lock that locks said safety in the closed position wherein said lock comprises an ambidextrous key-operated locking mechanism located and accessible on both sides of said firearm; and wherein said safety is pivoted about a pivot and said lock is not positioned at said pivot, wherein when said lock is in a locked position, said lock has a blocking portion that blocks movement of said safety about said pivot to the fire position and wherein said blocking portion comprises a lug that juts outwards from an outer surface of said firearm.

2. The article according to claim 1, wherein said safety comprises an active safety that must be moved to said fire position by an action independent of gripping the firearm, pulling a trigger and firing a projectile from the firearm.

3. The article according to claim 1, wherein said safety is an ambidextrous safety actuable from both sides of said firearm.

4. The article according to claim 1, wherein said safety is actuable from only one side of said firearm.

5. The article according to claim 1, wherein said safety doubles as an on-off switch for electrical accessories.

6. The article according to claim 1, wherein said key-operated locking mechanism comprises a ratchet mechanism.

7. The article according to claim 1, further comprising a visual indication adapted to indicate that the firearm is in at least one of the safe position and the fire position, said visual indication comprising a colored part that moves upon actuation of said key-operated locking mechanism, wherein in the safe position said colored part is moved to be visible and in the fire position is not visible.

8. The article according to claim 7, wherein said visual indication comprises a stripe that juts out together with said blocking portion.

9. The article according to claim 7, wherein said colored part moves together with said blocking portion that blocks movement of said safety about said pivot to the fire position.

* * * * *